US006788790B1

(12) United States Patent
Leysieffer

(10) Patent No.: US 6,788,790 B1
(45) **Date of Patent: *Sep. 7, 2004**

(54) IMPLANTABLE HEARING SYSTEM WITH AUDIOMETER

(75) Inventor: Hans Leysieffer, Taufkirchen (DE)

(73) Assignee: Cochlear Limited, Lane Cove NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/369,180

(22) Filed: Aug. 6, 1999

(30) Foreign Application Priority Data

Apr. 1, 1999 (DE) ..... 199 14 992

(51) Int. Cl.[7] ..... H04R 29/00
(52) U.S. Cl. ..... 381/60; 600/25
(58) Field of Search ..... 600/25, 559; 607/57, 607/55, 56; 381/314, 60

(56) References Cited

U.S. PATENT DOCUMENTS

| | | | | |
|---|---|---|---|---|
| 4,471,171 A | | 9/1984 | Köpke et al. | |
| 4,741,339 A | | 5/1988 | Harrison et al. | |
| 5,015,225 A | | 5/1991 | Hough et al. | |
| 5,277,694 A | | 1/1994 | Leysieffer et al. | |
| 5,279,292 A | | 1/1994 | Baumann et al. | |
| 5,411,467 A | * | 5/1995 | Hortmann et al. | 600/25 |
| 5,554,096 A | | 9/1996 | Ball | |
| 5,604,812 A | * | 2/1997 | Meyer | 381/314 |
| 5,624,376 A | | 4/1997 | Ball et al. | |
| 5,755,743 A | | 5/1998 | Volz et al. | |
| 5,788,711 A | | 8/1998 | Lehner et al. | |
| 5,795,287 A | | 8/1998 | Ball et al. | |
| 5,814,095 A | | 9/1998 | Müller et al. | |
| 5,999,856 A | * | 12/1999 | Kennedy | 607/57 |
| 6,118,877 A | | 9/2000 | Lindemann et al. | |
| 6,175,635 B1 | * | 1/2001 | Meyer et al. | 381/314 |
| 6,334,072 B1 | * | 12/2001 | Leysieffer | 607/57 |
| 6,394,947 B1 | * | 5/2002 | Leysieffer | 600/25 |

FOREIGN PATENT DOCUMENTS

| | | |
|---|---|---|
| DE | 32 05 685 A1 | 8/1983 |
| EP | 0 572 382 | 12/1993 |
| WO | WO 98/36711 | 8/1998 |

* cited by examiner

*Primary Examiner*—Minsun Oh Harvey
*Assistant Examiner*—Brian Pendleton
(74) *Attorney, Agent, or Firm*—Nixon Peabody LLP; David S. Safran

(57) ABSTRACT

Partially and fully implantable hearing system for rehabilitation of a pure sensorineural hearing loss or combined conduction and inner ear impairment, with a microphone (10) which delivers an audio signal, an electronic signal processing and amplification unit (40, 50, 80, 140, 141) which is located in an audio signal processing electronic hearing system path, an implantable electromechanical output transducer (20) and a unit (60) for power supply of the implant, an electronic module (90, 140, 141) being added to the hearing system and generating the audiometry signals for an audiologic study and evaluation of the coupling quality of the electromechanical output transducer (20) and feeding it into the audio signal processing path of the hearing implant.

23 Claims, 5 Drawing Sheets

IMPLANTABLE HEARING SYSTEM WITH AUDIOMETER

BACKGROUND OF THE INVENTION

1. Field of the Invention

The present invention is directed to partially and fully implantable hearing systems for rehabilitation of a pure sensorineural hearing loss or combined conduction and inner ear hearing loss with mechanical stimulation of the impaired ear.

2. Description of Related Art

Recently, partially and fully implantable hearing aids for rehabilitation of a pure inner ear hearing disorder or combined sound conduction and inner ear hearing disorder with mechanical stimulation of the damaged ear have become available on the market or will soon be available (journal HNO 46:844–852, 10-1998, H. P. Zenner et al., "Initial implantations of a completely implantable electronic hearing system in patients with an inner ear hearing disorder"; journal HNO 46:853–863, 10-1998, H. Leysieffer et al., "A completely implantable hearing system for inner ear hearing handicapped: TICA LZ 3001"; U.S. Pat. Nos. 5,277,694; 5,788,711; 5,814, 095; 5,554,096; and 5,624,376). Especially in fully implantable systems, is the visibility of the system not an issue, so that in addition to the advantages of high sound quality, the open auditory canal and full suitability for everyday use, high future patient acceptance can be assumed. Basically, in these implantable systems, the output signal is a mechanical vibratory stimulus which directly excites the middle ear or inner ear. The coupling of the mechanical excitation which is produced by an electromechanical transducer takes place by direct mechanical connection of the vibrating transducer element to the ossicle chain or an ossicle of the middle ear or to the inner ear (commonly assigned U.S. patent application Ser. No. 09/042,805) or by force coupling via an air gap in, for example, electromagnetic transducers.

The coupling quality of the mechanical excitation is influenced by many parameters and contributes significantly to rehabilitation of hearing loss and to the perceived hearing quality. Intraoperatively, this quality of coupling can only be assessed with difficulty or not at all, since the amplitudes of motion of the vibrating parts even at the highest stimulation levels are in a range around or far below 1 $\mu$m , and therefore, they cannot be assessed by direct visual inspection. Even as this is done using other technical measurement methods, for example, by intraoperative laser measurements (for example, laser doppler vibrometry), the uncertainty of a long-term stable, reliable coupling remains, since this can be adversely affected among others by necrosis formation, tissue regeneration, air pressure changes and other external and internal actions. In particular, in completely implantable systems, it remains necessary to be able to assess the coupling quality of the transducer, since in a full implant, it is not possible to separately measure individual system components at their technical interfaces if, for example, the implant wearer complains of inferior transmission quality which cannot be improved by reprogramming of individual audiologic adaptation parameters, and therefore, surgical intervention to improve the situation cannot be precluded. Even if this is not the case, there is fundamental scientific interest in having available a reliable monitor function of long term development of the quality of the transducer coupling.

International Patent Application Document WO 98/36711 proposes a method for this purpose which works with objective audiometric methods such as, for example, ERA (electric response audiometry), ABR (auditory brainstem response) or electrocochleography in partially and fully implantable systems with mechanical or electrical stimulation of the impaired or failed hearing. By electrical tapping via external head electrodes or implanted electrodes, stimulus responses which are evoked by application of suitable stimulating effects are objectively determined. The advantage of this method lies in that intraoperatively objective data of transmission quality can be obtained under full anesthesia. However, the major disadvantage, among others, is that these objective audiometric methods can only be of a qualitative nature, delivering essentially only data at the auditory threshold and/or only to a limited extent above threshold, and in particular, have only inadequate quantitative accuracy in frequency specific measurements. The subjective evaluation of transmission quality and subjective audiologic measurements in the range above threshold as, for example, loudness scales are not possible.

SUMMARY OF THE INVENTION

The primary object of this invention is to devise a partially or fully implantable hearing system which makes it possible, while circumventing these defects by psychoacoustic measurements, i.e, by subjective patient responses, to determine the coupling quality of the electromechanical transducer to the middle or inner ear without other biological-technical interfaces having been incorporated into the evaluation which adversely effect the reliability of the determination of transducer coupling quality.

Proceeding from a partially and fully implantable hearing system for rehabilitation of a pure sensorineural hearing loss or combined conduction and inner ear impairment with a microphone which delivers an audio signal, an electronic signal processing and amplification unit which is located in an audio signal processing electronic hearing system path, an implantable electromechanical output transducer and a unit for power supply of the implant, this object is achieved in accordance with the invention by an electronic audiometer unit being added to the hearing system and generating the audiometry signals for an audiologic, subjective study and evaluation of the coupling quality of the electromechanical output transducer and feeding it into the audio signal processing path of the hearing implant.

The audiometer module preferably is formed of one or more electronic signal generators which can be adjusted or programmed from the outside and which feed an electrical audiometry signal into the signal processing path of the implant. The electromechanical output transducer of the implanted hearing system becomes technically reproducible by the audiometer module and is directly triggered electrically in a quantitatively determined manner; in this way, adulteration of the stimulation level is prevented, as can occur, for example, by headphone and especially acoustic free field presentation of the audiometric test sound because, here, the sensor or microphone function with all pertinent variabilities is incorporated into the psychoacoustic measurement.

The system in accordance with the invention has the advantage, among others, that, for example, frequency-specific auditory threshold measurements with pure sinusoidal tones or narrowband signals (for example, third octave noise) can be very easily reproduced at longer study time intervals. Furthermore, the acquisition of reproducible psychoacoustic data in the supraliminal area, for example, loudness scalings, is also possible. In addition, by offering pure signals such as, for example, sinusoidal signals, nonlinearities can also be subjectively interrogated which can arise, for example, by diminishing coupling quality. These studies are possible only to a limited extent or not at all by the objective measurement methods described at the beginning on the basis of evoked potentials.

Basically, in the fully implantable systems, the approach according to the invention yields the advantage that the parameters of signaling such as, for example, the electrical operating level of the electromechanical implant transducer are quantitatively exactly determined and can be reproduced by the generators within the implant and are not subject to fluctuations, as occur, for example, in a full implant by acoustic headphone presentation of the test signals. In this last case, the transmission function of the implanted acoustic sensor (microphone) is incorporated into transmission at the same time. The sensor function can also be subject to time fluctuations and thus makes an exact interface definition for the output transducer transfer function impossible.

As the implantable electromechanical output transducer, especially a transducer as per U.S. Pat. No. 5,277,694 is suitable, i.e., a transducer in which one wall of the transducer housing is made as a vibratory membrane which together with a piezoelectric ceramic disk applied to the membrane inside, represents an electromechanically active heteromorphic composite element.

Another transducer design suitable for these purposes is described in commonly assigned U.S. patent application Ser. No. 09/097,710. It is a transducer arrangement for partially or fully implantable hearing aids for direct mechanical stimulation of the middle ear or inner ear, which is provided with a housing which can be fixed at the implantation site with respect to the skull and with a mechanically stiff coupling element which can move relative to the housing, the housing containing an electromechanical transducer with which the coupling element can be caused to vibrate; these vibrations are transmitted to the middle ear ossicle or directly to the inner ear after completed implantation of the transducer arrangement. The electromechanical transducer is made as an electromagnet arrangement which has a component which is fixed relative to the transducer housing, especially a ring coil, and a vibratory component, preferably in the form of a permanent magnetic pin which dips into the center opening of the ring coil and which is connected to the coupling element, such that the vibrations of the vibratory component are transmitted to the coupling element.

But, a transducer of the type described in commonly assigned U.S. patent application Ser. No. 09/311,563 is also advantageous. It is a transducer for partially or fully implantable hearing aids for direct mechanical excitation of the middle ear or inner ear which is provided with a housing which can be fixed at the implantation site and with a mechanically stiff coupling element which can move relative to the housing, the housing containing a piezoelectric transducer with which the coupling element can be caused to vibrate, these vibrations are transmitted to the middle ear ossicle or directly to the inner ear after completed implantation of the transducer. Furthermore, in the housing there is an electromagnet arrangement which has a component which is fixed relative to the housing and has a vibratory component which is connected to the coupling element such that the vibrations of the vibratory component are transmitted to the coupling element. This transducer has the advantage that the frequency response of the transducer can be improved, both compared to purely piezoelectric and purely electromagnetic systems, so that an adequate hearing impression at a sufficient loudness level is enabled. In particular, a largely flat frequency response of the deflection of the coupling element can be implemented in a wide frequency band at a sufficiently high stimulation level and low power consumption.

In the hearing system of the invention, preferably, patient-specific signal parameters for the audiometry function can be individually adapted to the requirements and pathological requirements of the patient by means of an electronic unit.

The electronic signal processing and amplification unit can have an amplifier downstream of the microphone, an audiologic signal processing stage supplied with the output signal of the amplifier and a driver amplifier upstream of the electromechanical output transducer. Advantageously, the electronic module can be provided with a signal generator arrangement for generating the signals necessary for the audiometry function and a summing element connected between the signal processing stage and the driver amplifier and via which both the output signal of the audiologic signal processing stage and also the output signal of the signal generator arrangement pass to the driver amplifier.

However, according to one modified embodiment of the invention, there can also be a digital signal processor as the audiological signal processing stage which is designed both for processing of the audio signal and also for generating the signals necessary for the audiometry function and for combining the latter signals with the audio signal. In this case, an analog to digital converter can be connected upstream of the signal processor and a digital to analog converter downstream of the signal processor.

The digital to analog converter and the driver amplifier can be combined in one module.

The signal processor is preferably equipped with a data storage for storing the patient-specific, audiologic adaptation parameters and/or parameters for generating the signals for the audiometry function.

To control at least a part and preferably all of the signal processing and/or generating stages there can advantageously be a microcontroller which has a data storage for storing patient-specific, audiologic adaptation parameters and/or the operating parameters of the signal generator arrangement.

However, the signal processor can also be designed itself for controlling at least one part and preferably all of the signal processing and/or generating stages.

For data input into the data storage, a telemetry unit is suitable which communicates by wire or wirelessly with an external programming system.

If the hearing aid is made to be fully implantable, preferably the signal processing and amplification unit which is in the electronic hearing system path, the electronic module for generating and feeding the signals necessary for the audiometry function and the telemetry unit as the electronic module are housed, together with the power supply unit, in a hermetically sealed and biocompatible implant housing. Here, the electronic module is advantageously connected via an implant line to a microphone which can be implanted subcutaneously in the posterior wall of the auditory canal and via an implantable line to the electromechanical output transducer. This connection can be made permanent or detachable. For a detachable connection, especially a plug-in connection as is described in particular in U.S. Pat. No. 5,755,743 is suitable. One such connection arrangement has at least a first contact, at least one second contact supported on an elastic body and a sealing mechanism for causing the face of the first contact to engage the face of the second contact, the first contact being surrounded by at least one sealing crosspiece which is pressed into the elastic body when the contacts engage and seals the contacts to the outside.

The output transducer can be coupled, preferably, via a coupling element to an ossicle of the middle ear chain for transmission of the output-side mechanical transducer vibrations.

Especially, the approaches of the type described in U.S. Pat. No. 5,277,694 and commonly assigned U.S. patent application Ser. No. 09/042,805 are suitable for this purpose. Here, advantageously, an actively vibratory part of the output transducer can be joined mechanically securely to a connecting rod which is coupled via a coupling element to part of the ossicle chain. To adjust the relative location of the connecting rod and coupling element and to fix these elements in the set relative position, the coupling element is preferably made sleeve-shaped at least in the fixing area and it can be plastically cold-deformed by means of a crimping tool, while the connecting rod is made bar-shaped at least in the fixing area, provided with a rough surface, and under the influence of the crimping force applied with the crimping tool, it cannot be plastically cold-deformed, in the fixed state, the sleeve-shaped part of the coupling element deformed by cold flow being attached permanently and without play on the bar-shaped part of the connecting rod. However, the end of the connecting rod away from the output transducer can also be inserted into a hole of a part of the ossicle chain and fixed there.

Furthermore, the output transducer can also be designed such that it can be coupled via an air gap to the ossicle chain or the inner ear, as is described in particular in U.S. Pat. No. 5,015,225.

A fully implantable hearing aid, in another embodiment of the invention, includes an external system for transcutaneous transfer of patient-specific hearing aid and audiometry programming data to the implant-side telemetry unit.

As the power supply unit in particular, a primary battery or a secondary, rechargeable element, i.e., a rechargeable battery, can be considered. In the latter case, the telemetry unit is additionally made, preferably, as a power receiving circuit for implant-side availability of recharging energy for the power supply unit, while the external system is at the same time built as a charger. In particular a charging system of the type known from U.S. Pat. No. 5,279,292 or arrangements as are described in commonly assigned U.S. patent applications Ser. Nos. 09/311,565 and 09/311,566are suitable for this purpose.

It is also possible for a portable remote control unit to be provided for setting or changing the hearing aid or audiometry functions.

In a partially implantable system, an implant part preferably has, in addition to the output transducer, a power and signal receiving interface and an electronic system connected between the receiving interface and the output transducer, with the components necessary for power supply and data regeneration, and an external system part comprises the microphone, an electronic module with the signal processing unit in the hearing aid path and the electronic module necessary for generation and feed of the signals necessary for the audiometry function, a driver unit and a power and signal transmitting interface connected to the output of the driver unit.

Furthermore, the partially implantable hearing system preferably includes an external system for transfer of patient-specific hearing aid and audiometry programming data to the electronic module of the external system part.

In the following, advantageous embodiments of the invention are explained using the drawings.

DETAILED DESCRIPTION OF THE INVENTION

Figure 1:
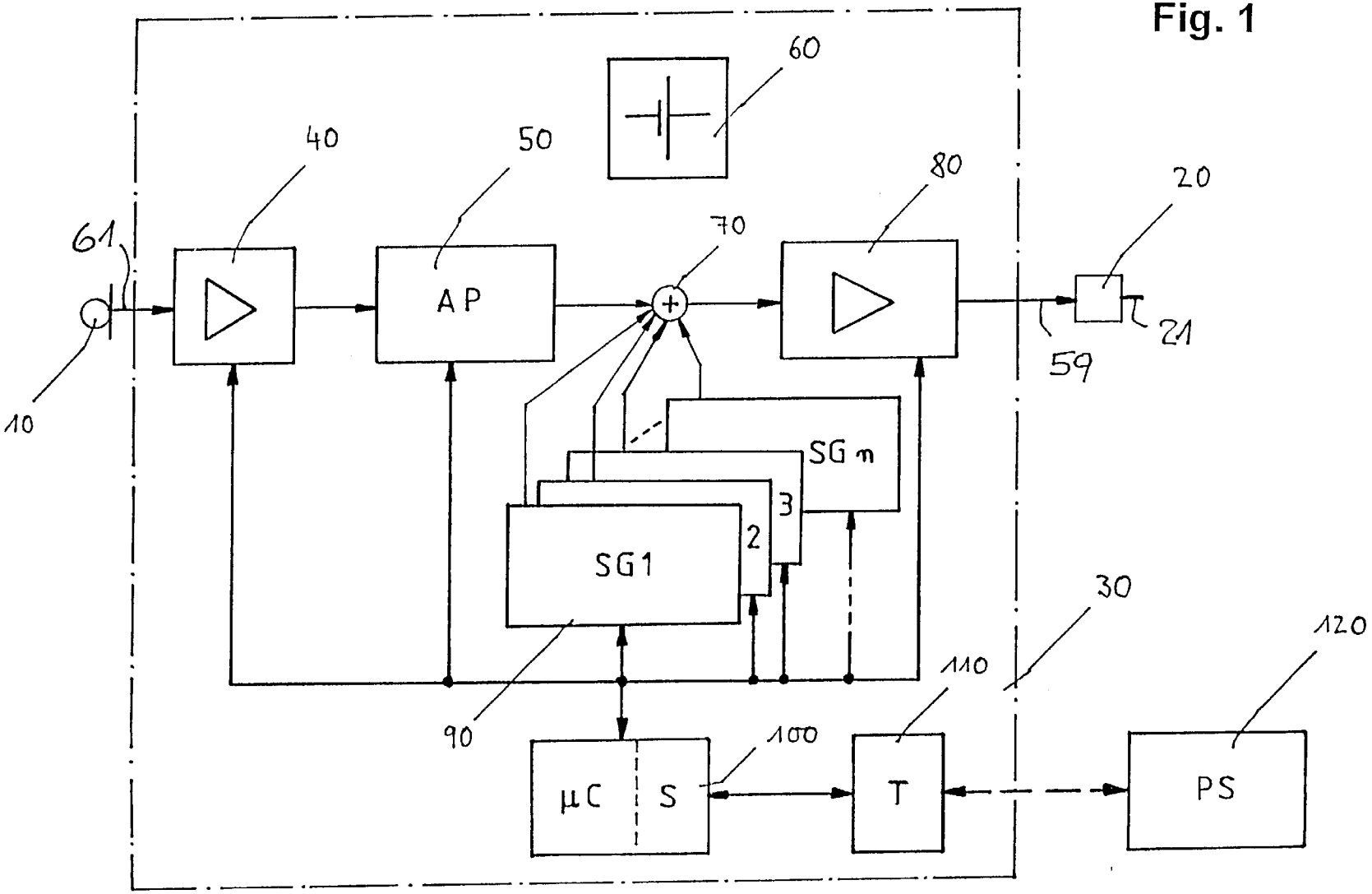
FIG. 1 is a block diagram of a fully implantable hearing system in accordance with the invention.

The implant system as shown in FIG. 1 has a microphone 10 which receives the acoustic signal and converts it into an electrical signal which is preamplified in an amplifier 40. This preamplified signal is further processed in an audiologic signal processing stage 50 (AP: "Audio Processor"). This stage can contain all known components conventional in modern hearing aids, such as filter stages, automatic gain controls, interference signal suppression means and so forth. This processed signal is sent to a summation element 70.

Further inputs of the signal combining element 70 are the output or outputs of one or more signal generators 90 (SG1 to SGn) which generate(s) the audiometer signal or signals. They can be individual sinusoidal signals, narrowband signals, broadband signals and the like, with a spectral location, level and phase ratios which can be adjusted to one another.

The audio signal processed by the stage 50 together with the audiometer signal or signals of the generator or generators 90 is sent to a driver amplifier 80 which triggers an electromechanical transducer 20. The transducer 20 stimulates the impaired inner ear by direct mechanical coupling via coupling element 21 to a middle ear ossicle or via an air gap coupling for implantable transducers which are electromagnetic, for example. The signal processing components 40, 50, 80 and the generators 90 are controlled by a microcontroller 100 ($\mu$C) with the pertinent data storage (S). In the storage area S, especially, patient-specific audiologic adaptation parameters and the audiometry parameters of the signal generator 90 can be filed. These individual programmable data are sent to the controller 100 via a telemetry unit 110 (T). This telemetry unit 110 communicates wirelessly or by wire bidirectionally with an external programming systems 120 (PS).

All electronic components of the system except for the programming system 120 are supplied with electrical operating power by a primary or rechargeable secondary battery 60.

In particular, in a fully implantable system, it is a good idea to combine all the described electronic signal processing circuit parts and the control components and the power supply in one module 30, this is shown in FIG. 1 by the dot-dash line. On the implant side, only the microphone 10 and the electromechanical transducer 20 are connected to the signal module 30 via the corresponding lines 61 or 59 permanently, or optionally, via implantable plug-in connections.

Figure 2:
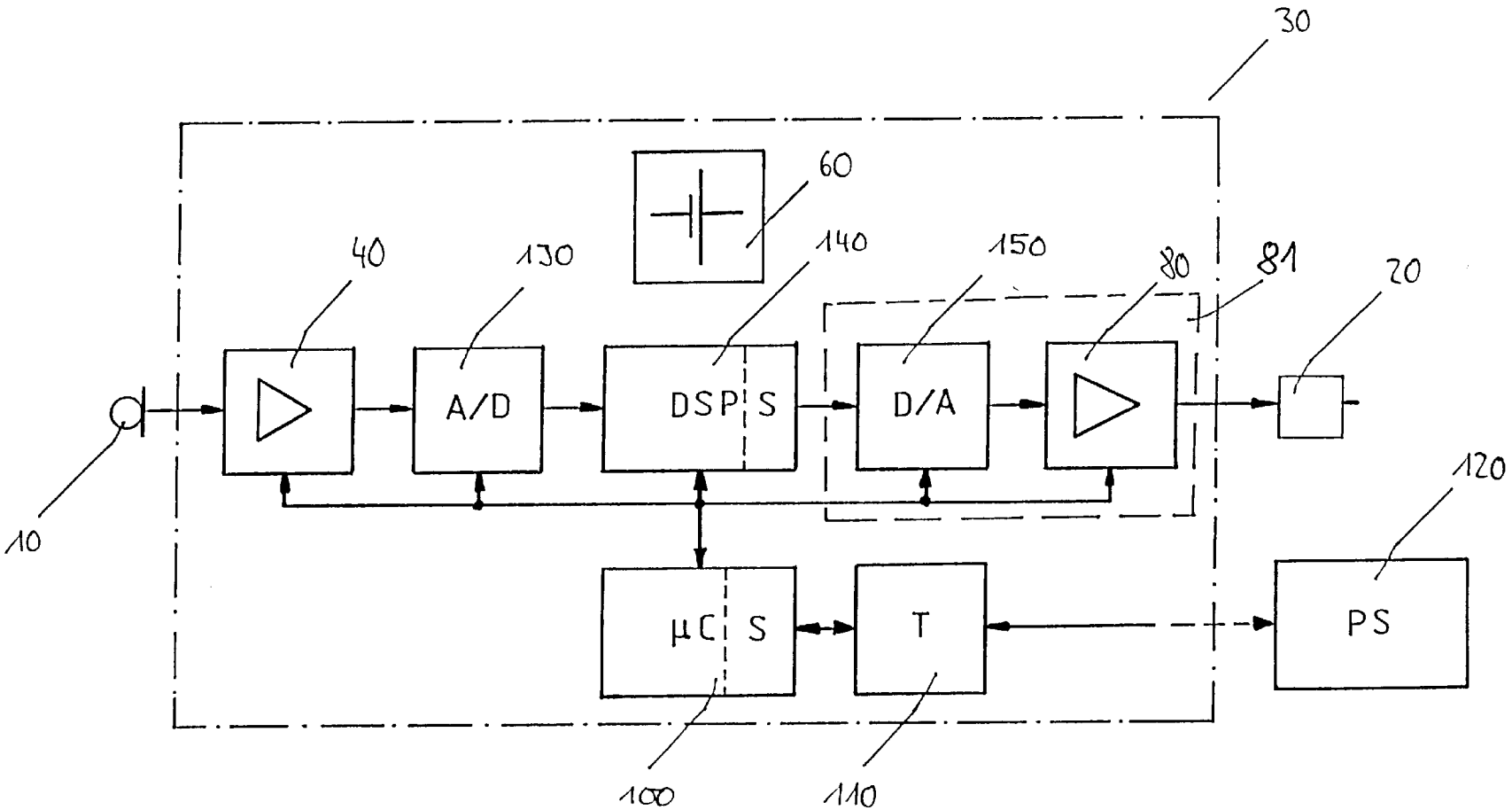
FIGS. 2 & 3 are block diagrams of modified embodiments of the fully implantable hearing system.

FIG. 2 shows another embodiment of the electronic signal module 30. The signal of the microphone 10 is preamplified in the amplifier 40, and by means of an analog-digital converter 130 (A/D), is converted into a digital signal which is sent to a digital signal processor 140 (DSP) with a data storage area S. The signal processor 140 assumes fundamentally two tasks: on the one hand, as in fully digital hearing aids, the audio signal is conventionally processed according to the described signal processing methods for rehabilitation of ear impairment. On the other hand, in the signal processor 140, the signal generators which generate the described audiometer signals are implemented using software. The combination of these digital audiometer signals and the processed and amplified audio signal takes place likewise in the signal processor 140. The digital output signal of the signal processor 140 is converted back into an analog signal in a digital-analog converter 150 (D/A), and is sent to the electromechanical transducer 20 via the driver amplifier 80.

The D/A converter 150 and the driver amplifier 80 can, as is shown in FIG. 2 by the block 81, be combined in one module. This is especially preferred in the case in which an electromagnetic system is used as the transducer 20 and the output signal of the signal processor 140 contains the signal information by pulse-width modulation, so that the time integration necessary for conversion back into an analog signal is performed directly by the transducer 20.

All signal processing components are controlled by a microcontroller 100 ($\mu$C) with the pertinent data storage (S). The storage area S of the microcontroller 100 can file especially patient-specific audiologic adaptation parameters and the individual operating parameters of the audiometer signal generators integrated into the signal processor 140. These individual programmable data are sent to the controller 100 via a telemetry unit 110 (T). This telemetry unit 110 communicates wirelessly or by wire bidirectionally with an external programniing system 120 (PS). All electronic components of the system 120 are supplied with electrical operating power by the primary or secondary battery 60.

Figure 3:
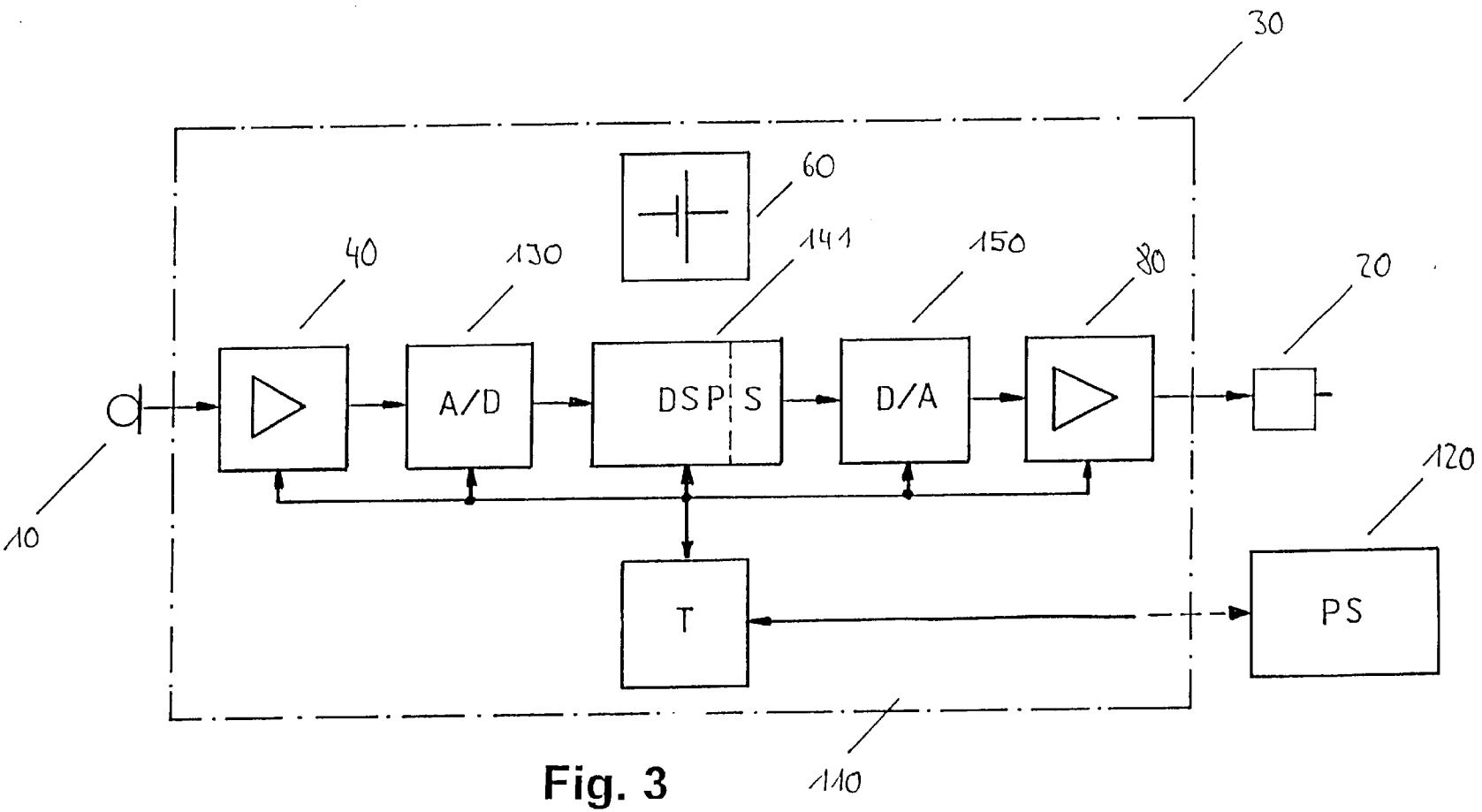

The embodiment as shown in FIG. 3 differs from that of FIG. 2 essentially only in that there is a signal processor 141 which also assumes the functions of the microcontroller 100 as shown in FIG. 2. Here, the patient-specific data of audio signal processing and the audiometer functions are then likewise filed in the data storage area S of the signal processor 141.

Figure 4:
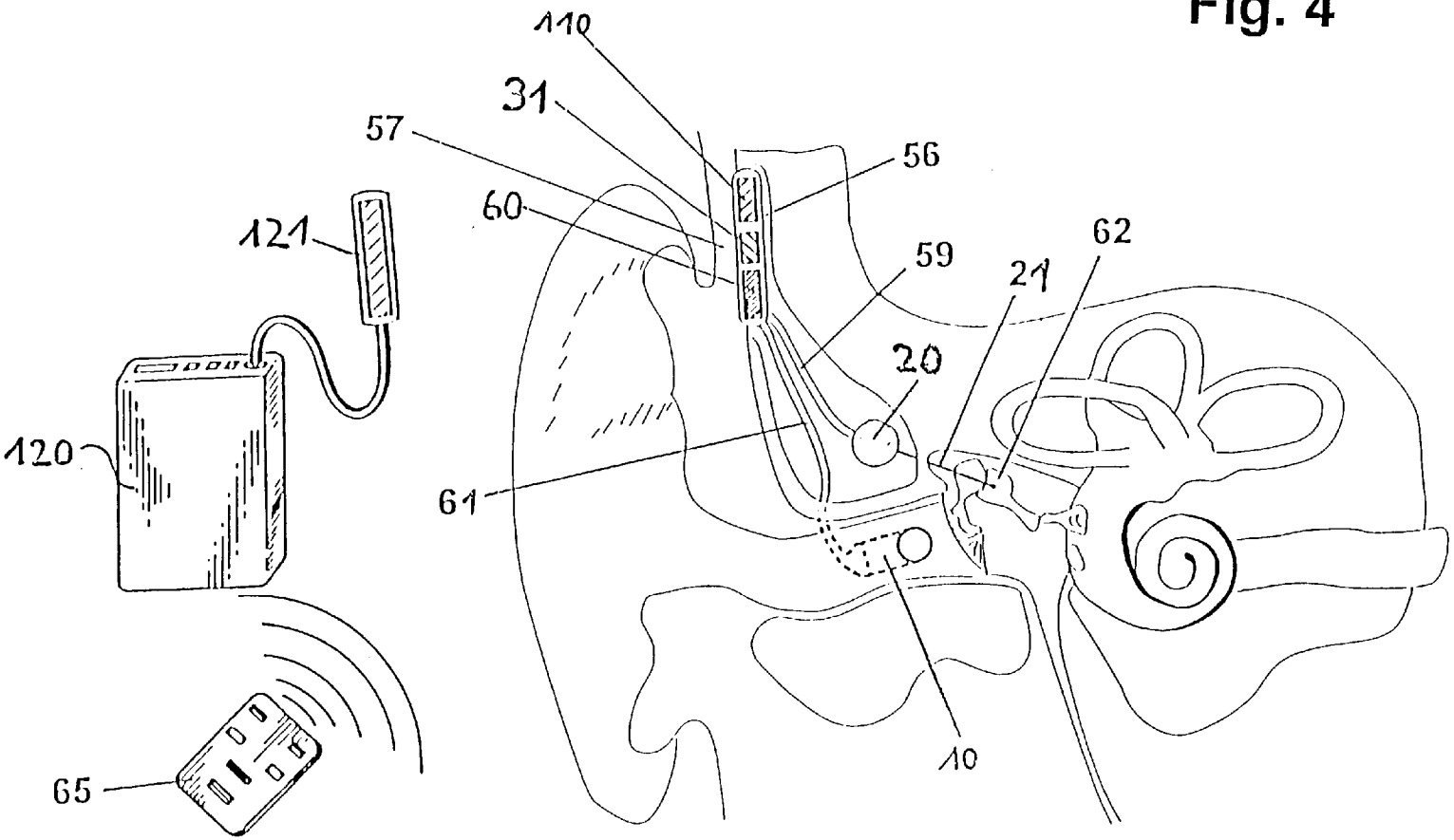
FIG. 4 is a schematic of a fully implanted hearing system in the implanted state.

FIG. 4 shows one possible fully implantable embodiment as shown in FIG. 1, FIG. 2 or FIG. 3 in schematic form. A hermetically sealed and biocompatible implant housing 56 holds an electronic module 31 (shown without the battery), which corresponds to the module 30 of FIGS. 1, 2, and 3 except for the absence of a battery. Furthermore, the housing 56 contains the battery 60 for electrical supply of the implant and the telemetry means 110. The microphone 10 is subcutaneously implanted preferably in the manner known from U.S. Pat. No. 5,814,095, optionally, using the fixation element described in commonly assigned U.S. patent application Ser. No. 09/097,710 in the posterior wall of the auditory canal. The microphone 10 receives the sound and converts it into an electrical signal which is supplied via the implant line 61 to the electronic module 31 in the housing 56. The audiologically processed and amplified signal to which the corresponding audiometer signals are added by the electronic unit 31 travels via the implantable line 59 to the electromechanical transducer 20. This transducer 20, in this example, is shown as a directly coupled system, i.e., the output-side mechanical vibrations of the transducer 20 are coupled directly via a suitable coupling element 21 to an ossicle of the middle ear chain, in this case to the anvil 62. Preferably, this takes place in the manner known from U.S. Pat. Nos. 5,277,694 and 5,788,711. The transducer vibrations coupled in there travel via the ossicle chain to the inner ear and there cause the corresponding auditory impression.

Furthermore, FIG. 4 shows the external programming system 120 with which, as described, the patient-specific hearing aid data and the audiometer parameters are transferred transcutaneously through the closed skin 57 to the implant-side telemetry unit 110. To do this, a transmitting head 121 is used which is placed above the implant for (bidirectional) data transfer and transfers the data, for example, inductively. If the battery 60 in the implant housing 56 is a secondary, rechargeable element, the unit 110 can also be a power receiving circuit for implant-side availability of recharging energy. Then, the external system 120 with the transmitting head 121 is a wireless charger which is portable, for example. Here, preferably, there can be arrangements as are known from U.S. Pat. No. 5,279,292 or as are described in commonly assigned U.S. patent applications Ser. Nos. 09/311,565 and 09/311,566. Furthermore, a portable remote control unit 65 is shown with which the patient can adjust or change important hearing aid functions.

Figure 5:
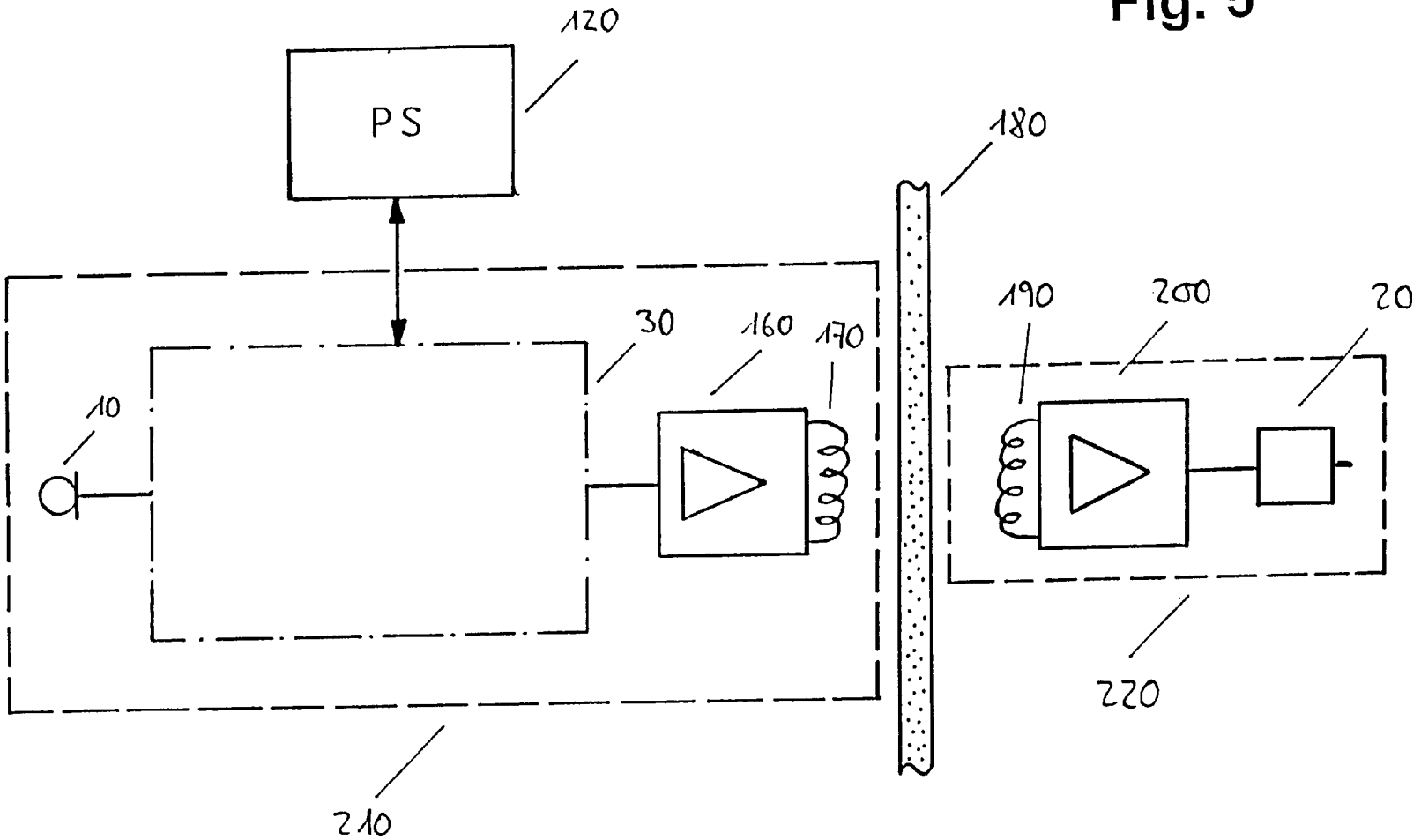
FIG. 5 is a block diagram of a partially implantable hearing system in accordance with the invention.

FIG. 5 schematically shows a partially implantable system. Here, the implantable part is shown as the subsystem 220 and the external part which is to be worn outside on the body is shown as the block 210. The external unit 210 contains the microphone 10, a signal processing unit 30 and the driver unit 160 which transfers the generated signals and operating power for the implant part for example via the transmitting coil 170 inductively and transcutaneously through the closed skin 180 to the implanted system part 220. This type of transmission corresponds to transmission in known, partially implantable cochlea implants or partially implantable hearing aids (see, among others, U.S. Pat. Nos. 4,741,339, and 5,795,287, as well as published European Patent Application 0 572 382). The electronic unit 30 of the external system part 210 contains all necessary electronic components for hearing aid signal processing and for producing the audiometer signals as are explained, for example, using FIGS. 1 to 3. The individual programming of the external system with patient-specific hearing aid data and with audiometer parameters takes place via the programming system 120 which, as in conventional hearing aids, is conventionally coupled in this case by wire to the electronic unit 30. On the implant-side, the system 220 comprises a power and signal receiving interface, in this case, an inductive receiving coil 190. The electronic system 200 contains all components necessary for power supply and data regeneration, such as demodulators and driver circuits for the electromechanical transducer 20.

I claim:

1. An at least partially implantable hearing system for rehabilitation of a pure inner ear hearing disorder or combined sound conduction and inner ear hearing disorder, with a microphone which delivers an audio signal, an electronic signal processing and amplification unit which is located in an audio signal processing electronic hearing system path, an implantable electromechanical output converter and a unit for supplying power to the system and an electronic module which generates audiometry signals for an audiologic, subjective study and evaluation of the coupling quality of the electromechanical output converter and feeds it into the audio signal processing path, wherein the electronic signal processing and amplification unit has an audiological signal processing stage comprising a signal processor, which processes the audio signal and also generates the audiometry signals and combines the audiometry signals with the audio signal.

2. Hearing system as claimed in claim 1, further comprising means for adapting patient-specific signal parameters for the audiometry function to the individual requirements of the patient by means of an electronic unit.

3. Hearing system as claimed in claim 1, wherein the electronic signal processing and amplification unit has an amplifier downstream of the microphone, the audiologic signal processing stage supplied with an output signal of the amplifier and a driver amplifier upstream of the electromechanical output converter.

4. Hearing system as claimed in claim 3, wherein the electronic module has a signal generator arrangement for generating the signals necessary for the audiometry function and a summing element connected between the signal processing stage and the driver amplifier, via which both the output signal of the audiologic signal processing stage and also the output signal of the signal generator arrangement pass to the driver amplifier.

5. Hearing system as claimed in claim 3, wherein the signal processor is a dugital signal processor.

6. Hearing system as claimed in claim 5, wherein an analog to digital converter is connected upstream of the signal processor and a digital to analog converter is connected downstream of the signal processor.

7. Hearing system as claimed in claim 6, wherein the digital to analog converter and the driver amplifier are combined in one module.

8. Hearing system as claimed in claim 5, wherein the signal processor has a data storage for storing at least one of patient-specific, audiologic adaptation parameters and parameters for generating the audiometry signals.

9. Hearing system as claimed in claim 1, wherein at least part of signal processing by the electronic signal processing and amplification unit and signal generating by the electronic module is controlled by a microcontroller.

10. Hearing system as claimed in claim 9, wherein the microcontroller has a data store for storing at least one of patient-specific, audiologic adaptation parameters and operating parameters of the electronic module.

11. Hearing system as claimed in claim 5, wherein the signal processor controls at least part of the signal processing by the electronic signal processing and amplification unit and signal generating by the electronic module.

12. Hearing system as claimed in claim 10, wherein for data input into the data store there is a telemetry unit.

13. Hearing system as claimed in claim 12, characterized by an external programming system which communicates with the telemetry unit.

14. Hearing system as claimed in claim 12, wherein the system is made fully implantable by the signal processing and amplification unit and the electronic module being housed together with the power supply unit in a hermetically sealed and biocompatible implant housing.

15. Hearing system as claimed in claim 14, wherein the electronic module is connected via an implant line to a microphone which is of a size and shape adapted for being implanted subcutaneously in the rear wall of the auditory passage.

16. Hearing system as claimed in claim 14, wherein the electronic module is connected via an implantable line to the electromechanical output converter.

17. Hearing system as claimed in claim 1, wherein a coupling element is provided for coupling the output converter to an ossicle of the middle ear chain for transmission of output-side mechanical converter vibrations.

18. Hearing system as claimed in claim 1, wherein the output converter is coupleable, via an air gap, to one of the ossicle chain and the inner ear.

19. characterized Hearing system as claimed in claim 18, characterized by an external system for transcutaneous transfer of patient-specific hearing system and audiometry programming data to the implant-side telemetry unit.

20. Hearing system as claimed in claim 19, wherein the power supply unit comprises a secondary, rechargeable element, and wherein the telemetry unit is additionally a power receiving circuit for recharging the power supply unit, and wherein the external system comprises a charger.

21. Hearing system as claimed in claim 20, characterized by a portable remote control unit for setting functions of the hearing system.

22. Hearing system as claimed in claim 1, wherein the system is partially implantable, an implantable part having the output converter, a power and signal receiving interface and an electronic system connected between the receiving interface and the output transducer with components necessary for power supply and data regeneration, and an external system part comprising the microphone, an electronic unit with the signal processing and amplification unit and the electronic module, a driver unit, and a power and signal transmitting interface connected to an output of the driver unit.

23. Hearing system as claimed in claim 22, characterized by an external system transferring patient-specific hearing aid and audiometry programming data to the electronic unit of the external system.

* * * * *